US009917361B2

(12) United States Patent
Moon et al.

(10) Patent No.: US 9,917,361 B2
(45) Date of Patent: Mar. 13, 2018

(54) VARIABLE BEAM CONTROL ANTENNA FOR MOBILE COMMUNICATION SYSTEM

(71) Applicant: KMW INC., Hwaseong, Gyeonggi-Do (KR)

(72) Inventors: Young-Chan Moon, Gyeonggi-Do (KR); Sung-Hwan So, Gyeonggi-Do (KR); In-Ho Kim, Gyeonggi-Do (KR); Oh-Seog Choi, Gyeonggi-Do (KR); Hyoung-Seok Yang, Gyeonggi-Do (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 119 days.

(21) Appl. No.: 14/444,439

(22) Filed: Jul. 28, 2014

(65) Prior Publication Data

US 2014/0333500 A1 Nov. 13, 2014

Related U.S. Application Data

(63) Continuation of application No. PCT/KR2013/002917, filed on Apr. 8, 2013.

(30) Foreign Application Priority Data

Apr. 12, 2012 (KR) ..... 10-2012-0038113

(51) Int. Cl.
*H01Q 3/08* (2006.01)
*H01Q 1/12* (2006.01)
(Continued)

(52) U.S. Cl.
CPC ..... *H01Q 3/08* (2013.01); *H01Q 1/1264* (2013.01); *H01Q 1/246* (2013.01); *H01Q 1/42* (2013.01);
(Continued)

(58) Field of Classification Search
CPC ..... H01Q 3/02; H01Q 3/32; H01Q 21/0025; H01Q 21/08; H01Q 21/061; H01Q 21/062
See application file for complete search history.

(56) References Cited

U.S. PATENT DOCUMENTS 2,595,271 A * 5/1952 Kline ..... H01Q 3/20 343/761
4,110,009 A 8/1978 Bunch
(Continued)

FOREIGN PATENT DOCUMENTS

CN 1 428 014 A 7/2003
CN 2678153 Y 2/2005
(Continued)

OTHER PUBLICATIONS

[No Author Listed] AET: Applied Electromagnetic Technology, LLC.—Universal Spherical Dipole Source(USDS). Website. Last Accessed Jul. 9, 2015. 2 pages.

*Primary Examiner* — Daniel J Munoz
(74) *Attorney, Agent, or Firm* — Mintz Levin Cohn Ferris Glovsky and Popeo, P.C.; Kongsik Kim; Colleen H. Witherell

(57) ABSTRACT

The present invention relates to a variable beam control antenna for a mobile communication system, the antenna comprising: a radome formed on the front surface at which a signal is emitted; multiple emitters vertically arranged in at least one row; a frame portion for supporting the radome and the multiple emitters; and a direction-changing module which rotates each of the multiple emitters vertically and horizontally with respect to a reference point in order to change the emission direction of the multiple emitters.

5 Claims, 13 Drawing Sheets

(51) Int. Cl.

| | |
|---|---|
| ***H01Q 1/24*** | (2006.01) |
| ***H01Q 1/42*** | (2006.01) |
| ***H01Q 21/08*** | (2006.01) |
| ***H01Q 3/18*** | (2006.01) |
| ***H01Q 19/13*** | (2006.01) |
| ***H01Q 21/06*** | (2006.01) |
| ***H01Q 1/48*** | (2006.01) |
| ***H01Q 9/28*** | (2006.01) |

(52) U.S. Cl.

CPC ..... *H01Q 1/48* (2013.01); *H01Q 3/18* (2013.01); *H01Q 9/28* (2013.01); *H01Q 19/13* (2013.01); *H01Q 21/062* (2013.01); *H01Q 21/08* (2013.01)

(56) References Cited

U.S. PATENT DOCUMENTS

| | | | | |
|---|---|---|---|---|
| 4,379,297 | A | 4/1983 | Chevallier | |
| 4,862,185 | A * | 8/1989 | Andrews | H01Q 3/20 343/761 |
| 4,878,062 | A | 10/1989 | Craven et al. | |
| 5,818,385 | A | 10/1998 | Bartholomew | |
| 6,218,999 | B1 * | 4/2001 | Bousquet | H01Q 3/02 343/757 |
| 6,640,110 | B1 | 10/2003 | Shapira et al. | |
| 6,664,928 | B2 | 12/2003 | Ogawa et al. | |
| 6,864,837 | B2 | 3/2005 | Runyon et al. | |
| 8,047,518 | B2 | 11/2011 | Grange et al. | |
| 2002/0101384 | A1 | 8/2002 | Brooker et al. | |
| 2003/0095077 | A1 | 5/2003 | Livadiotti | |
| 2005/0134512 | A1 | 6/2005 | Gottl et al. | |
| 2006/0109193 | A1 | 5/2006 | Williams | |
| 2006/0229048 | A1 * | 10/2006 | Carroll | H01Q 1/246 455/268 |
| 2008/0158894 | A1 | 7/2008 | Dixon et al. | |
| 2008/0278271 | A1 | 11/2008 | Blalock | |
| 2008/0282828 | A1 | 11/2008 | Jones | |
| 2009/0274130 | A1 * | 11/2009 | Boch | H01Q 1/125 370/338 |
| 2010/0201590 | A1 | 8/2010 | Girard et al. | |
| 2011/0032158 | A1 | 2/2011 | Rodger et al. | |
| 2011/0063183 | A1 | 3/2011 | Sanford | |
| 2012/0280874 | A1 | 11/2012 | Kim et al. | |

FOREIGN PATENT DOCUMENTS

| | | | |
|---|---|---|---|
| CN | 1780054 | A | 5/2006 |
| CN | 101107475 | A | 1/2008 |
| EP | 1 014 482 | A2 | 6/2000 |
| JP | 08-321713 | A | 12/1996 |
| JP | 09-331289 | A | 12/1997 |
| JP | 2003-060431 | A | 2/2003 |
| JP | 2003-133824 | A | 5/2003 |
| JP | 2003-152419 | A | 5/2003 |
| JP | 2007-180819 | A | 7/2007 |
| JP | 2008-236189 | A | 10/2008 |
| KR | 2005-0064401 | A | 6/2005 |
| KR | 2007-0049459 | A | 5/2007 |
| WO | WO-2008/037051 | A1 | 4/2008 |
| WO | 2009-070623 | A1 | 6/2009 |
| WO | WO-2011/078565 | A2 | 6/2011 |

* cited by examiner

VARIABLE BEAM CONTROL ANTENNA FOR MOBILE COMMUNICATION SYSTEM

CROSS-REFERENCE TO RELATED APPLICATIONS

This application is a continuation application of International Application No. PCT/KR2013/002917 filed on Apr. 8, 2013, which claims priority to Korean Application No. 10-2012-0038113 filed on Apr. 12, 2012, which applications are incorporated herein by reference.

TECHNICAL FIELD

The present invention relates to an antenna applied to a base station or a repeater in a mobile communication system, and more particularly, to a variable beam control antenna designed to enable the antenna's vertical beam tilt adjustment, horizontal steering adjustment, horizontal beam width control, etc.

BACKGROUND ART

Vertical beam tilt control antennas, which are capable of vertical (and/or horizontal) beam tilting, have recently been widely used as base station antennas in mobile communication systems due to many advantages.

Beam tilt schemes of vertical beam tilt control antennas can be largely divided into a mechanical beam tilt scheme and an electric beam tilt scheme. The mechanical beam tilt scheme is based on a manual or powered bracket structure provided at a portion coupled to a support pole in a conventional antenna. Operation of such a bracket structure varies the installation inclination of the antenna and enables the antenna's vertical beam tilt. The electric beam tilt scheme is based on multiple phase shifters and enables electric vertical beam tilt by varying the phase difference of signals supplied to respective antenna radiation elements arranged vertically. An example of technology related to such vertical beam tilt is disclosed in U.S. Pat. No. 6,864,837 of Donald L. Runyon et al. (entitled "VERTICAL ELECTRICAL DOWNTILT ANTENNA", assigned to EMS Technologies, Inc., and issued on Mar. 8, 2005).

In addition, a technology has recently been developed which controls the antenna beam in the horizontal direction and thereby adjusts the sector aiming direction in conformity with the distribution of subscribers of the cell site. Horizontal control of the antenna beam can be conducted in two schemes, including an electric horizontal beam control scheme, which employs at least two columns of antennas and performs electric phase control of signals supplied to respective columns, and a control scheme which employs one column of antennas and horizontally moves them mechanically (steering).

When adjusting the horizontal aiming direction, furthermore, horizontal beam width variation is indispensable to suppress generation of shaded areas and minimize overlapping zones. As a technology for varying the horizontal beam width, there is a scheme which implements at least two rows of antennas in the horizontal direction and mechanically controls the horizontal aiming direction of reflection plates of respective rows so as to crisscross, thereby controlling the beam width. An example of such technology is disclosed in Korean Patent Application No. 2003-95761, entitled "MOBILE COMMUNICATION BASE STATION ANTENNA BEAM CONTROL APPARATUS", filed by the present applicant.

As such, antennas for mobile communication systems have a request for a structure enabling vertical beam tilt adjustment, horizontal steering adjustment, and horizontal beam width control, as well as an increasing demand for formation of more optimized beam patterns for respective sectors, but application of such a structure requires that comparatively complicated, high-cost mechanical equipment be additionally employed, which could possibly make antenna characteristics unstable.

SUMMARY

Therefore, an aspect of the present invention is to provide a variable beam control antenna for a mobile communication system, which has excellent stability during antenna installation, which has a reduced possibility of malfunctioning due to external environments, which has more stabilized antenna characteristics, which has a simpler structure, which enables vertical beam tilt adjustment, horizontal steering adjustment, and horizontal beam width control, and which is accordingly suitable for high functionality, low cost production, and network optimization.

In accordance with an aspect of the present invention, there is provided a variable beam control antenna for a mobile communication system, the variable beam control antenna including: a radome formed on a front surface from which signals are radiated; a number of radiation units vertically arranged in at least one column; a frame unit configured to support the radome and the radiation units; and a direction variable module configured to rotate each of the radiation units upwards/downwards and leftwards/rightwards with respect to one reference point so as to vary a radiation direction of the radiation units.

Preferably, each of the radiation units includes: a radiation element; a reflection plate configured to support the corresponding radiation element at a rear surface of the radiation element; a spherical structure connected to the reflection plate via a first connection rod; and a support platform configured to support the spherical structure using a ball-and-socket joint.

Preferably, the direction variable module has a structure configured to rotate the first connection rod upwards/downwards and leftwards/rightwards using a separate appendage connected directly/indirectly.

Preferably, the separate appendage is at least one second connection rod formed on a second shaft that is perpendicular to, on a plane, a first shaft of the spherical structure to which the first connection rod and the reflection plate are connected, and the at least one second connection rod is fixedly connected to a rotation center shaft of at least one pinion gear.

Preferably, the direction variable module includes: at least one rack gear unit elongated upwards/downwards to be connected to at least one pinion gear installed on at least one second connection rod of the spherical structure; an up/down variable unit configured to support the at least one rack gear unit while enabling the rack gear unit to move upwards/downwards and installed to be able to rotate leftwards/rightwards with respect to a vertical shaft of the spherical structure (26); and a left/right variable unit configured to rotate the up/down variable unit leftwards/rightwards with respect to the vertical shaft of the spherical structure.

Preferably, the rack gear unit is commonly connected to pinion gears formed on second connection rods of respective spherical structures of the radiation units.

As described above, the variable beam control antenna for a mobile communication system according to the present invention has excellent stability during antenna installation, has a reduced possibility of malfunctioning due to external environments, has more stabilized antenna characteristics, has a simpler structure, and enables vertical beam tilt adjustment, horizontal steering adjustment, and horizontal beam width control.

DETAILED DESCRIPTION

Figure 1:
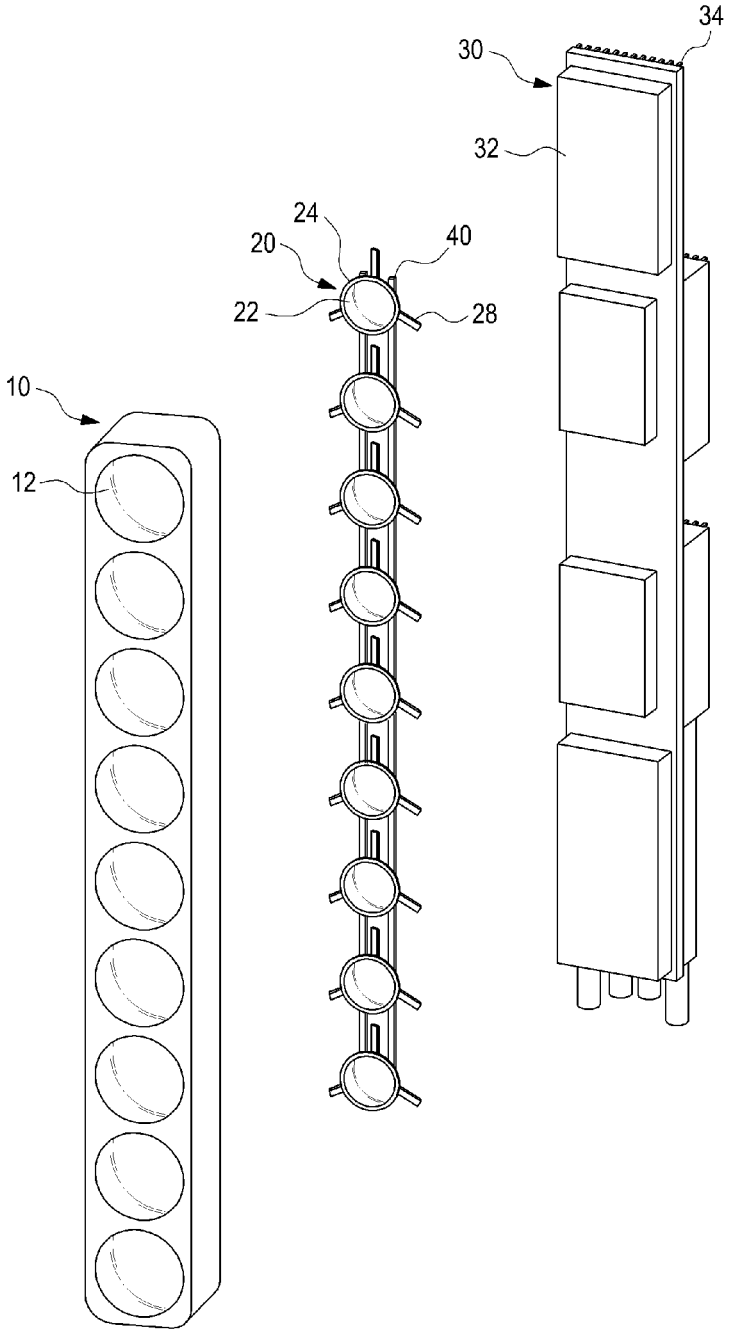
FIG. 1 is a schematic exploded perspective view illustrating a structure of a variable beam control antenna for a mobile communication system according to an embodiment of the present invention.

Hereinafter, an exemplary embodiment of the present invention will be described in detail with reference to the accompanying drawings. In the drawings, the same components are given the same reference numerals.

FIG. 1 is a schematic exploded perspective view illustrating a structure of a variable beam control antenna for a mobile communication system according to an embodiment of the present invention. Referring to FIG. 1, the antenna according to an embodiment of the present invention includes a radome 10 formed on a front surface from which signals are radiated; a number of radiation units 20 arranged vertically; a frame unit 30 supporting the radome 10 and the radiation units 20; and a direction variable module (including a rack gear unit 40, an up/down variable unit 50, and a left/right variable unit 60 described later) configured to rotate each of the radiation units 20 upwards/downwards and leftwards/rightwards with respect to one reference point in response to an external control signal so that the radiation direction of the radiation units 20 is variable.

The frame unit 30 may be additionally provided with signal processing and control equipment 32 for signal processing operations, such as amplification and filtering of transmitted/received signals of the corresponding antenna, and control operations related to posture control of the antenna and the like, and heat radiation fins 34 may be formed on its outer surface to discharge heat generated from the corresponding equipment 32. Alternatively, the equipment 32 may be implemented as a separate device having a separate housing and then installed additionally on the outside of the antenna.

Each of the radiation units 20 has a radiation element 22; a reflection plate 24 supporting each radiation element 22 at the rear surface of the corresponding radiation element 22; and a support platform 28 supporting the reflection plate 24 of each radiation unit 20 so that, while the reflection plate 24 can rotate with respect to one reference point, its position is fixed about the corresponding reference point.

Each radiation element 22 may be configured as a dipole element having a conventionally structured radiator and a balloon structure and, as will be described later, the dipole element may have a radiator, which has a number of radiation pattern units on which resonance patterns are formed, formed in a partially spherical shape which is convex towards the front as a whole, as well as feeding and balloon structures for supporting and feeding the corresponding radiator. Each reflection plate 24 may be shaped as a dish or a portion that is concave with respect to the radiation element 22.

It can be understood that, although conventional antenna structures typically have a number of radiation elements arranged on a single elongated planar reflection plate, the present invention does not adopt such a structure, but a reflection plate of a suitable structure is separately installed for each radiation element. That is, unlike the conventional structure of arranging a number of radiation elements on one planar reflection plate, the present invention can avoid the problem of PIMD (Passive Inter-Modulation Distortion) resulting from fastening of each radiation element and, since each radiation element is not affected by adjacent radiation elements, each radiation element can be designed optimally. Furthermore, each reflection plate 24 has a partially spherical shape according to the present invention, which makes it possible to increase the area of the reflection plate, compared with a planar reflection plate, within the same volume.

Figure 4:
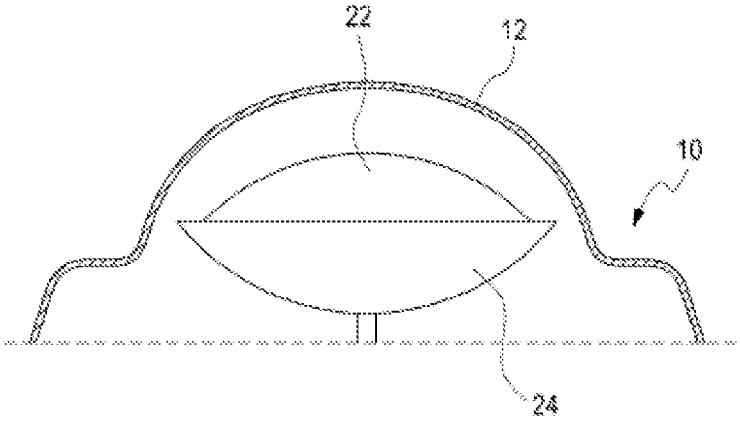
FIG. 4 illustrates an arrangement structure of a radome and a radiation unit.

The radome 10 is formed so that its surfaces, which correspond to the convex radiation elements 22 of respective radiation units 20, similarly have partially spherical surfaces 12 that are convex towards the front; and, as illustrated in FIG. 4 more clearly, the partially spherical surfaces 12 of the radome 10 are formed so that, even when the radiation elements 22 rotate upwards/downwards, leftwards/rightwards, a constant distance is maintained between the radome 12 and the radiation elements 22. This prevents any change of electric characteristics regarding separate tilt of each radiation element 22. In addition, the radome 10 can have a slim overall structure as a result of optimized design conforming to the shape of the radiation elements. Such a spherical shape is also favorable in terms of the drag coefficient, and the influence of wind is reduced compared with conventional radome structures, thereby reducing the burden on the tower where it will be installed. When signal processing and control equipment 32 and the like are added to the antenna, particularly, reduction of weight and wind-related drag has a significant importance, which is a significant advantage of the radome structure according to the present invention over the conventional structures.

Figure 2A:
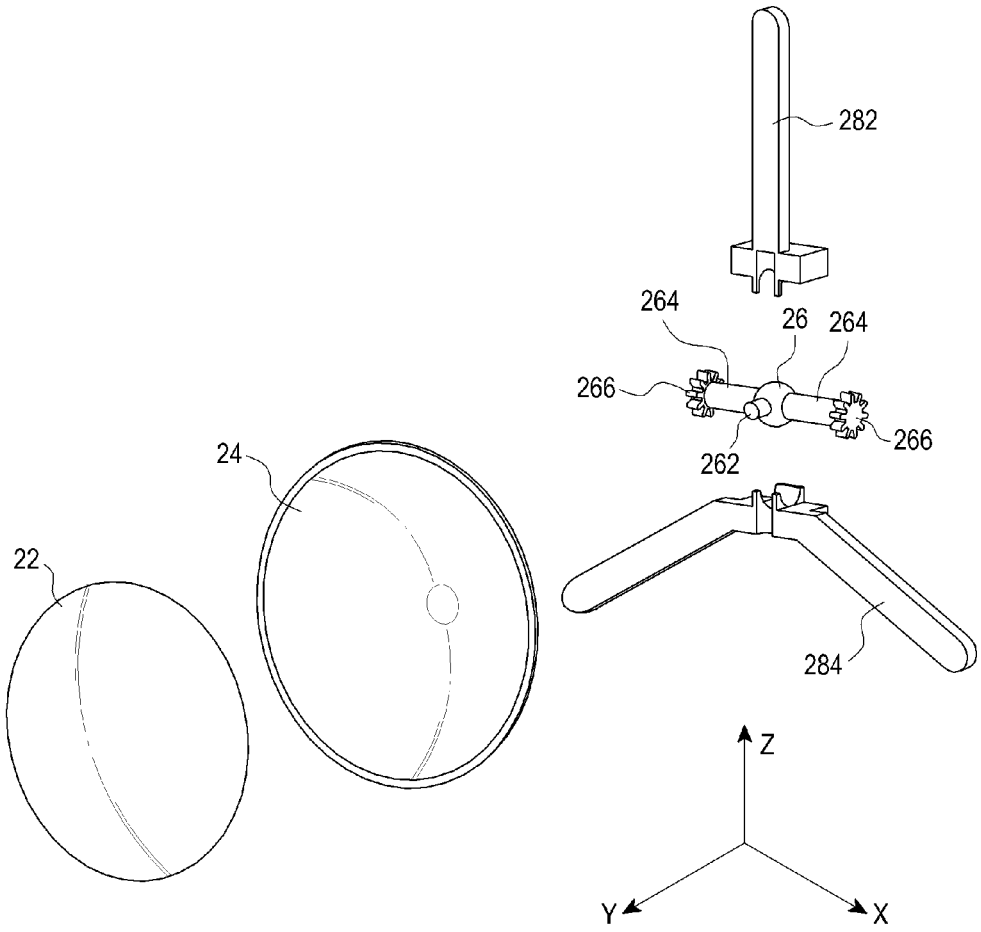
FIG. 2A to FIG. 2E illustrate detailed structures of one radiation unit of FIG. 1.
Figure 2B:
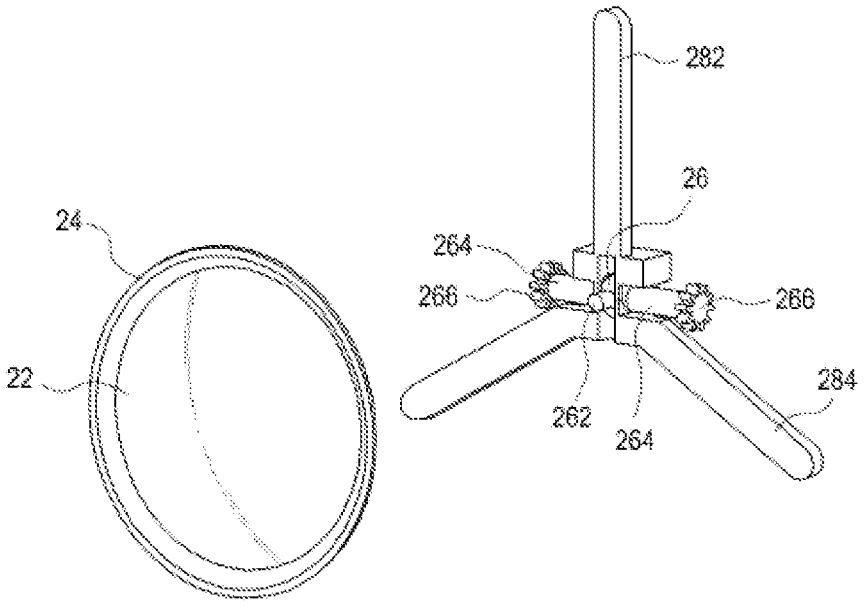
Figure 2C:
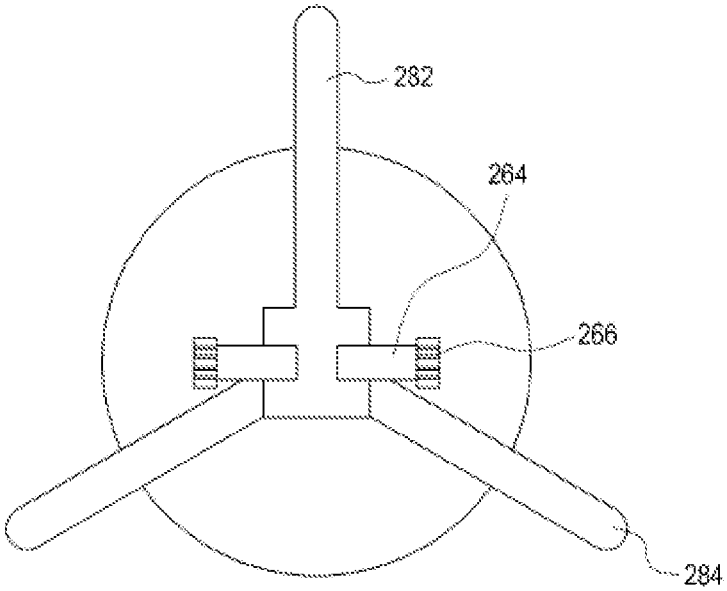
Figure 2D:
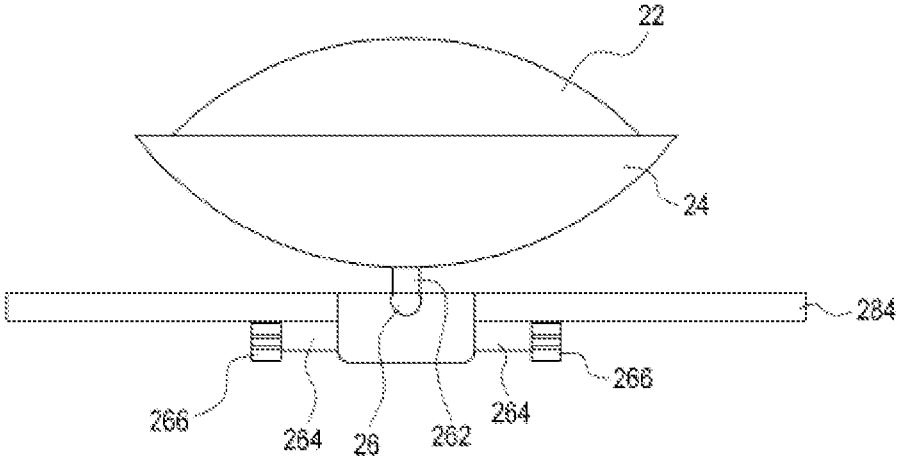
Figure 2E:
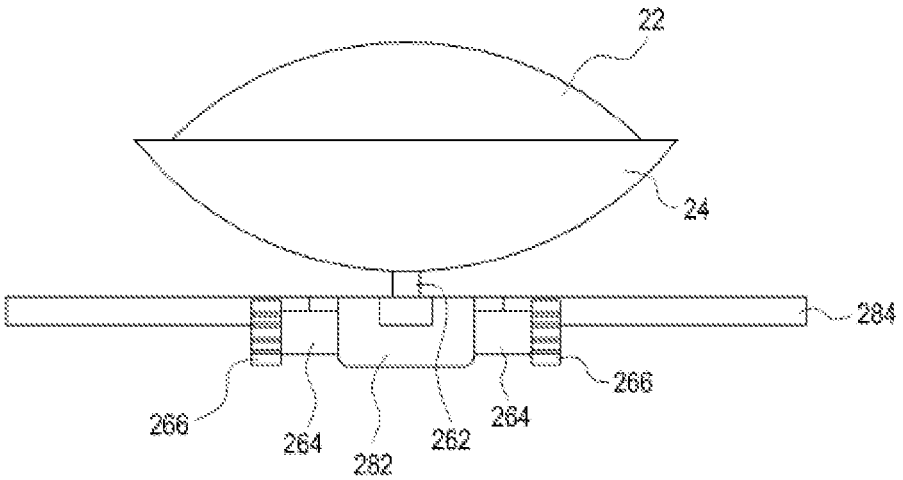

FIG. 2A to FIG. 2E illustrate a detailed structure of one radiation unit of FIG. 1; specifically, FIG. 2A is an exploded perspective view of the radiation unit; FIG. 2B is a partially assembled perspective view of FIG. 2A; FIG. 2C is a rear view of the radiation unit; FIG. 2D is a planar view of the radiation unit; and FIG. 2E is a top view of the radiation unit. Referring to FIG. 2A to FIG. 2E, each of the radiation units 20 according to an embodiment of the present invention has a radiation element 22, a reflection plate 24, and a spherical structure 26 connected to the center portion of the rear surface of the reflection plate 24 via a first connection rod 262 so that a first axis (e.g. Y-axis, which is assumed for convenience to extend towards the front) is fixed. The spherical structure 26 has at least one second connection rod 264 fixed and connected to a rotation center shaft of at least one pinion gear 266 along a second axis (e.g. X-axis, which is assumed for convenience to extend in the leftward/rightward direction), which is perpendicular to the first axis on the same plane.

The support platform 28, which supports the reflection plate 24 of the radiation unit 20 to be able to rotate with respect to one reference point, may include an upper support platform 282 and a lower support platform 284 fixed and coupled to each other; the upper support table 282 and the lower support table 284 are configured to surround the upper and lower portions of the spherical structure 26, respectively, and fix the position of the spherical structure 26, thereby supporting the radiation unit 20.

The support platform 28 has a recess or hole structure formed so that the first connection rod 262 of the spherical structure 26 can rotate upwards/downwards and leftwards/rightwards within a preset range with reference to the spherical structure 26, and has a recess or hole structure formed so that the second connection rod 264 of the spherical structure 26 can rotate leftwards/rightwards within a preset range with reference to the spherical structure 26. The support platform 28 may be installed to be fixed to the inner surface of the radome 10 or the frame unit 30 by screw coupling, for example.

It is clear from the above-described structure that a rotation of the pinion gear 266 connected to the second connection rod 264 is followed by a rotation of the spherical structure 26, which is then followed by an upward/downward rotation of the first connection rod 262 with reference to the spherical structure 26, which is finally followed by an upward/downward rotation of the rotation unit 20. In addition, a leftward/rightward rotation of the second connection rod 264 with reference to the spherical structure 26 is followed by a leftward/rightward rotation of the first connection rod 262 with reference to the spherical structure 26, which is finally followed by an upward/downward rotation of the radiation unit 20.

Such a structure of connection of the spherical structure 26 and the support table 28 and the structure of rotation of the radiation unit 20 through the spherical structure 26 may be similar to fixing and rotating structures using a ball-and-socket joint. That is, the spherical structure 26 corresponds to the ball of the ball-and-socket joint, and the support platform 28 corresponds to the socket of the ball-and-socket joint.

In this case, the radiation unit 20 is rotated upwards/downwards and leftwards/rightwards by having a structure (e.g. direction variable module) for upward/downward and leftward/rightward rotations of the first connection rod 262, which connects the radiation unit 20 to the spherical structure 26, using a separate appendage (e.g. the second connection rod 264) that is connected directly/indirectly.

Figure 3A:
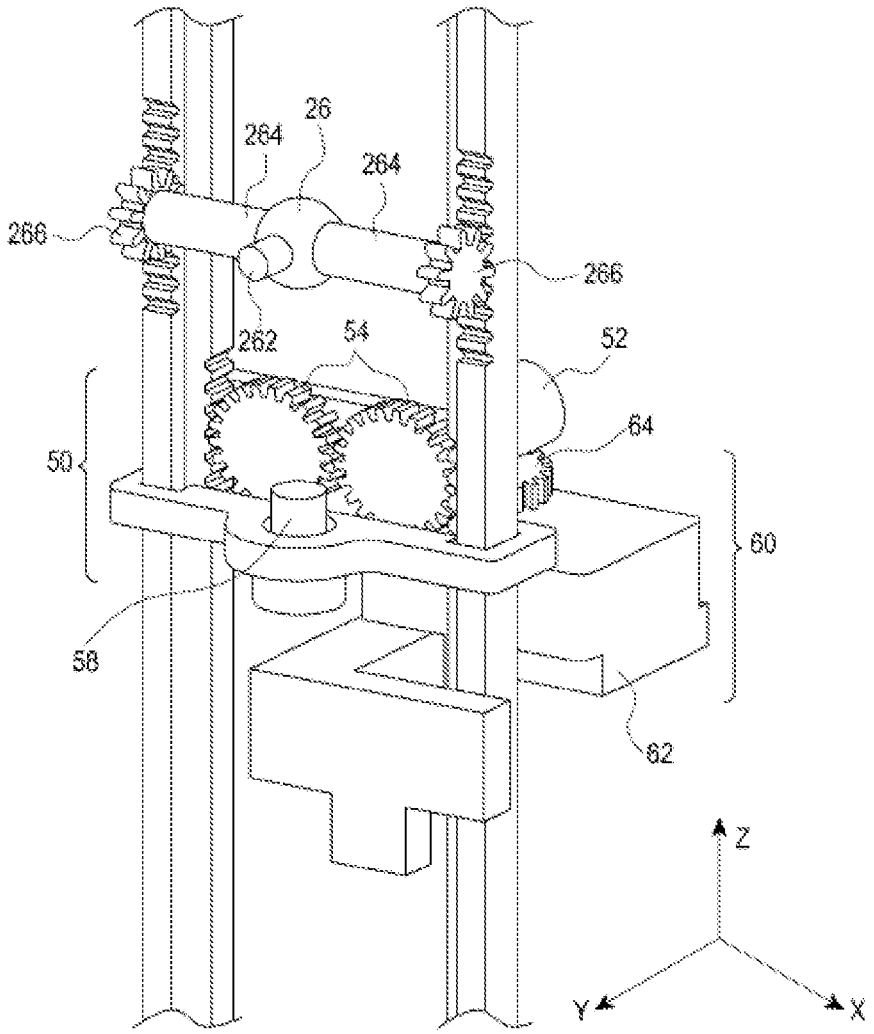
FIG. 3A to FIG. 3E illustrate detailed structures of a direction variable module of FIG. 1.
Figure 3B:
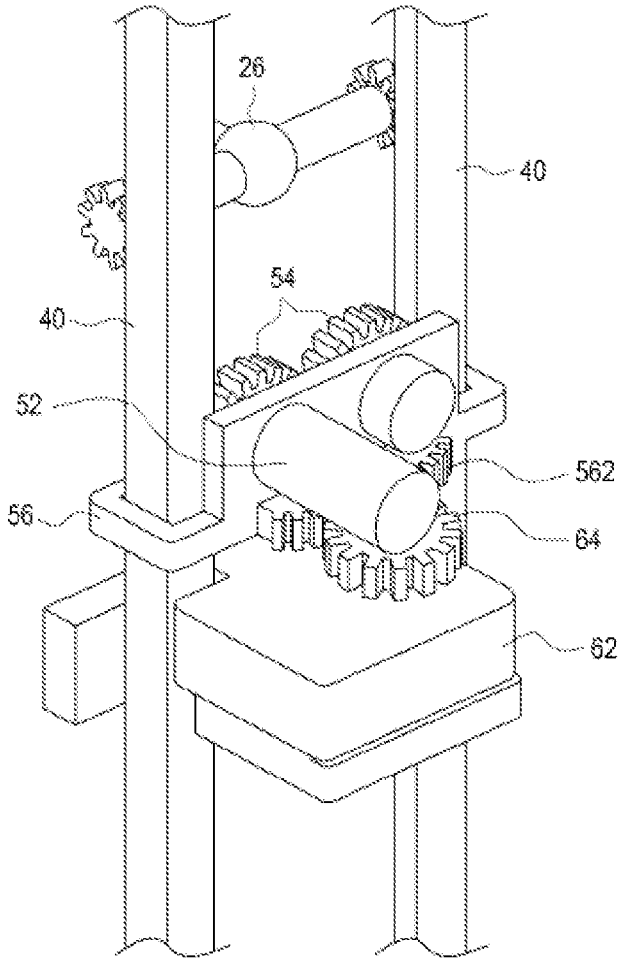
Figure 3C:
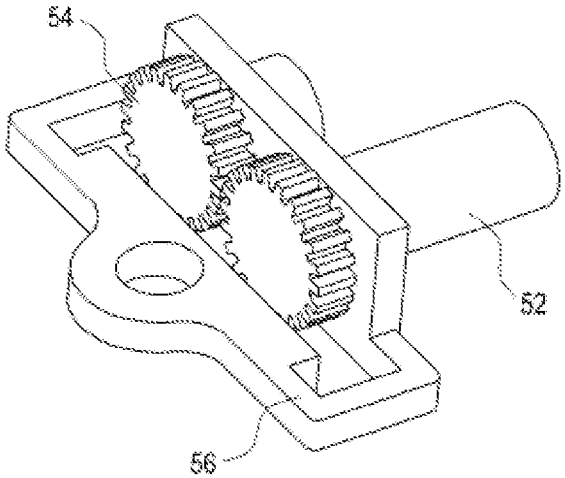
Figure 3D:
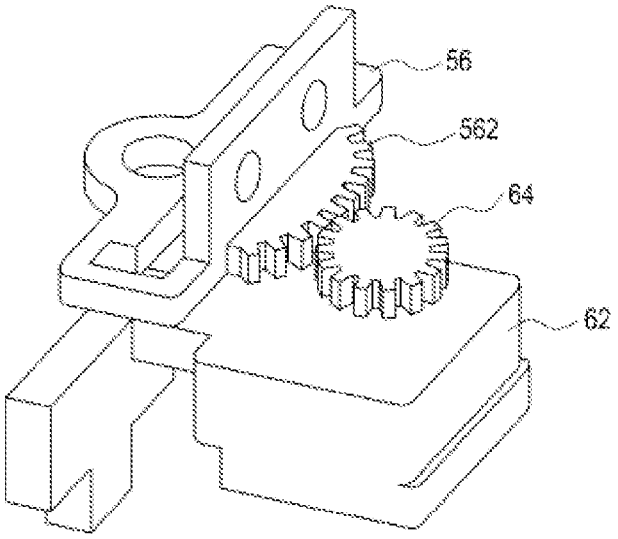
Figure 3E:
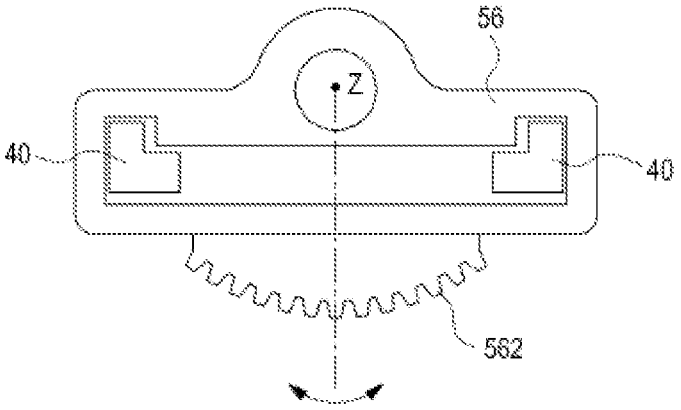

FIG. 3A to FIG. 3E illustrate a detailed structure of the direction variable module of FIG. 1; specifically, FIG. 3A is an overall perspective view of the direction variable module seen in one direction; FIG. 3B is an overall perspective view of the direction variable module seen in another direction; FIG. 3C is a perspective view of major portions of an up/down variable unit of the direction variable unit; FIG. 3D is a perspective view of major portions of a left/right variable unit of the direction variable module; and FIG. 3E is a planar view of related portions illustrating a left/right variable state of FIG. 3D. Referring to FIG. 3A to FIG. 3E, the direction variable module according to an embodiment of the present invention includes at least one rack gear unit 40 elongated upwards/downwards to be connected to at least one pinion gear 266 installed on at least one second connection rod 264 of the spherical structure 26; an up/down variable unit 50 configured to support the at least one rack gear unit 40 while enabling the rack gear unit 40 to move upwards/downwards and installed to be able to rotate leftwards/rightwards with reference to a vertical axis (e.g. Z-axis) of the spherical structure 26; and a left/right variable unit 60 configured to rotate the up/down variable unit 50 leftwards/rightwards with reference to the vertical axis (Z-axis) of the spherical structure 26.

The up/down variable unit 50 has at least one first rotation gear 54 rotated by a first motor 52, and the at least one first rotation gear 54 is configured to be connected to a rack gear structure formed on a surface of the rack gear unit 40, which is connected to the pinion gear 266 of the second connection rod 264, or formed on another surface thereof. As a result, a rotation of the first motor 52 causes a rotation of the first rotation gear 54, which is followed by an upward/downward movement of the rack gear unit 40 connected thereto, which finally causes a rotation of the pinion gear 266 of the second connection rod 264.

The first motor 52 and the at least one first rotation gear 54 may be installed to be fixed to a guide/fixing structure 56, and the guide/fixing structure 56 has a structure for supporting the rack gear unit 40 to be able to move upwards/downwards by inserting it into a recess structure, and a structure to be installed to be able to rotate leftwards/rightwards with reference to the vertical axis (Z-axis) of the spherical structure 26. For example, the guide/fixing structure 56 may be structured to be fixed with its one side inserted into an auxiliary support platform 58, which is installed to be elongated along the vertical axis (Z-axis) of the spherical structure 26 while being fixed to the support platform 28 illustrated in FIG. 2A to FIG. 2E. It is obvious that, in this case, the guide/fixing structure 56 itself is installed not to move upwards/downwards.

The guide/fixing structure 56 may have a rotation gear structure 562 partially formed on one side and configured to rotate about the vertical axis (Z-axis) of the spherical structure 26. The rotation gear structure 562 rotates while interworking with the left/right variable unit 60; as a result, the up/down variable unit 50 rotates in the leftward/rightward direction as a whole; the rack gear unit 40, which is connected thereto, rotates with reference to the vertical axis (Z) of the spherical structure 26; the second connection rod 264 of the spherical structure 26 rotates leftwards/rightwards; and, finally, the radiation unit 20 rotates leftwards/rightwards.

The left/right variable unit 60 has a second rotation gear 64 rotated by a second motor 62, and the second rotation gear 64 is configured to engage with the rotation gear structure 562 of the guide/fixing structure 56. The second motor 62 of the left/right variable unit 60 may be installed to be fully fixed through a separate structure, and, for example, it may be connected to be fixed to the lower end of the auxiliary support platform 58. Such a structure guarantees that a rotation of the second motor 62 causes a rotation of the second rotation gear 64, which causes a rotation of the rotation gear structure 562 of the guide/fixing structure 56 connected thereto.

The above-mentioned rack gear unit 40 may be commonly connected to the pinion gears 266 formed on the second connection rods 264 of respective spherical structures 26 of a number of radiation units 20. As a result, provision of only one up/down variable unit 50 and left/right variable unit 60 can vary the upwards/downwards and leftward/rightwards directions of a number of radiation units 20 as a whole.

Furthermore, when a number of rack gear units 40, up/down variable units 50, and left/right variable units 60 are separately provided for respective radiation units 20, instead of commonly connecting the rack gear unit 40 to a number of radiation units 20, the upwards/downwards and leftwards/rightwards directions may be varied differently for respective radiation units 20. This structure may be adopted to form a more optimized, precise beam pattern, although the number of provided components will increase. In this case, furthermore, the up/down variable units 50 may be configured to directly rotate the pinion gears 266 installed on the second connection rods of the spherical structures 26, without having to provide the rack gear unit 40.

In connection with the antenna structure according to an embodiment of the present invention described above, a conventional vertical and horizontal beam variable antenna may have a rotation shaft, which is for the purpose of rotating the antenna, positioned above/below a planar reflection plate configured as a single unit as a whole, and such a structure has structural instability during rotation. In contrast, according to the present invention, the rotation shaft for each radiation element is supported, and a driving unit can be arranged in the middle of the antenna, so that instability during rotation can be improved remarkably.

Furthermore, according to the present invention, a rotation shaft of a ball-and-socket joint type can be implemented so that upwards/rightwards and leftwards/rightwards movements can be made with reference to one center point (center of the ball-and-socket joint), which minimizes the size of the mechanical driving unit and thereby reduces the entire volume and weight of the antenna.

Figure 5:
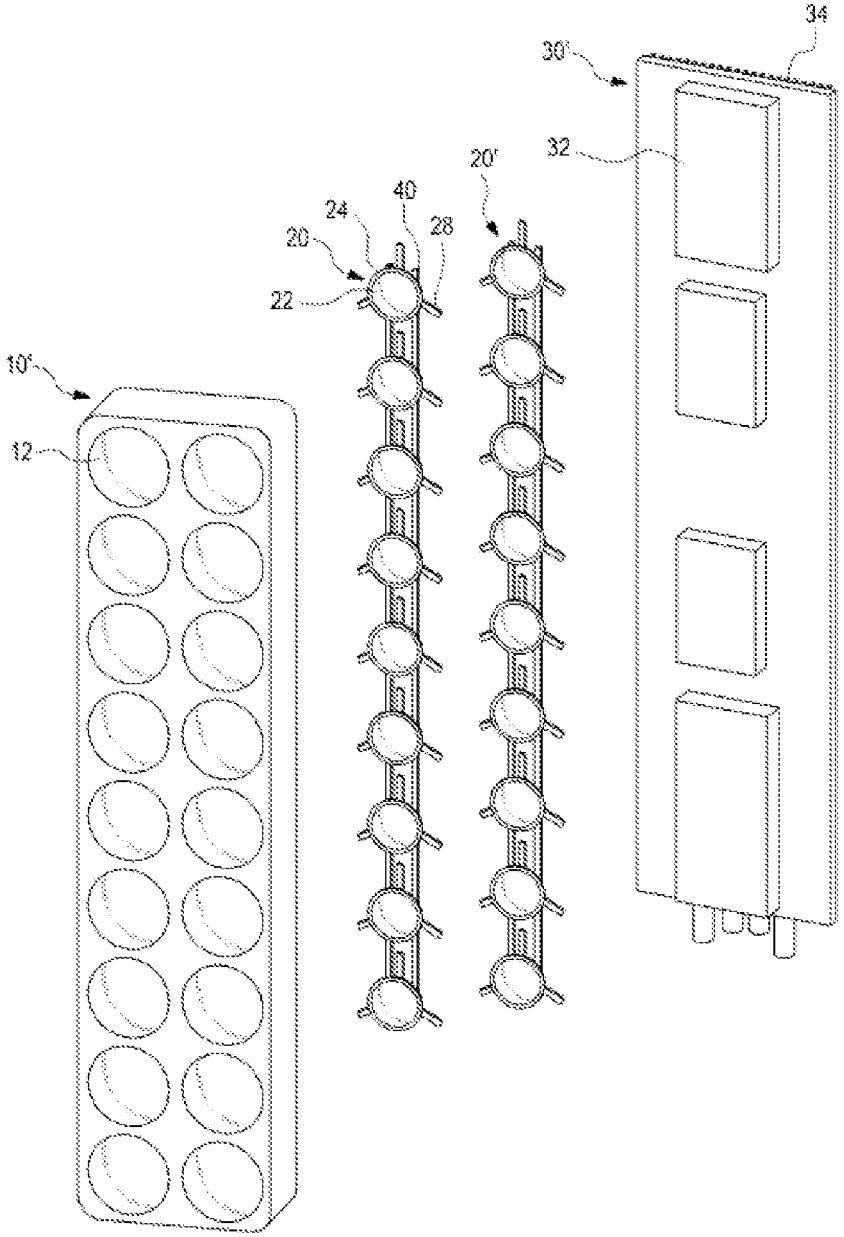
FIG. 5 is a schematic exploded perspective view illustrating a structure of a variable beam control antenna for a mobile communication system according to another embodiment of the present invention.

FIG. 5 is a schematic exploded perspective view illustrating a structure of a variable beam control antenna for a mobile communication system according to another embodiment of the present invention. Referring to FIG. 5, the antenna according to another embodiment of the present invention includes a radome 10' formed on a front surface, from which signals are radiated; a number of radiation units 20, 20' vertically arranged in two columns; a frame unit 30' supporting the radome 10' and the radiation units 20, 20' vertically arranged in two columns; and a direction variable module configured to vary the radiation direction of the radiation units 20, 20' vertically arranged in two columns. It can be understood that the structure illustrated in FIG. 5 can be obtained by arranging the radiation units 20 of the structure according to the first embodiment illustrated in FIG. 1 to FIG. 4, as well as related structures, in two columns (twofold). The detailed structure of each component may be similar to the structure according to the first embodiment described above.

A variable beam control antenna for a mobile communication system according to embodiments of the present invention can be configured as described above, and, although detailed embodiments of the present invention have been described above, the structure of the present invention can be variously changed or modified.

For example, radiation units may be arranged in two or at least three columns according to other embodiments of the present invention, as illustrated in FIG. 5, and, in this case, radiation units of at least one column may be configured to adopt the structure according to the present invention.

In addition, multiple phase shifters may be installed additionally to implement electric vertical beam tilt in another embodiment of the present invention, and, in this case, the multiple phase shifters may be mounted on the rack gear unit 40. As a result, the multiple phase shifters can move and rotate together with the rack gear unit, thereby preventing any twisting of cables connecting between the multiple phase shifters and respective radiation elements and reducing stress applied to the connection cables.

In addition, when two rack gear units 40 are provided, there may be further provided a separate fixing structure for fixing the two rack gear units 40 to each other at a suitable position and an additional guide structure for guiding upwards/downwards and rotational movements of the rack gear units 40, in order to stably support the two rack gear units 40.

The invention claimed is:

1. A variable beam control antenna for a mobile communication system, the variable beam control antenna comprising:

a radome formed on a front surface from which signals are radiated;

a number of radiation units vertically arranged in at least one column;

a frame unit configured to support the radome and the radiation units; and a direction variable module configured to rotate each of the radiation units upwards or downwards and leftwards or rightwards with respect to one reference point so as to vary a radiation direction of the radiation units, wherein each of the radiation units comprises:

a radiation element;

a reflection plate configured to support the corresponding radiation element at a rear surface of the radiation element;

a spherical structure connected to the reflection plate via a first connection rod; and a support platform configured to support the spherical structure using a ball-and-socket joint, wherein the direction variable module has a structure configured to rotate the first connection rod and the spherical structure upwards or downwards and leftwards or rightwards using a separate appendage connected directly or indirectly, wherein the separate appendage is at least one second connection rod formed on a second shaft that is perpendicular to, on a plane, a first shaft of the spherical structure to which the first connection rod and the reflection plate are connected, and the at least one second connection rod is fixedly connected to a rotation center shaft of at least one pinion gear, wherein the direction variable module comprises:

a rack gear unit elongated upwards or downwards to be connected to at least one pinion gear installed on at least one second connection rod of the spherical structure;

an up or down variable unit configured to support the rack gear unit while enabling the rack gear unit to move upwards or downwards and installed to be able to rotate upwards or downwards with respect to a vertical shaft of the spherical structure; and a left or right variable unit configured to rotate the up or down variable unit leftwards or rightwards with respect to the vertical shaft of the spherical structure, wherein the rack gear unit is commonly connected to pinion gears formed on second connection rods of respective spherical structures of the radiation units, and wherein the radiation units connected to the rack gear unit rotates upwards or downwards and leftwards or rightwards simultaneous by operation of the up or down variable unit and the left or right variable unit.

2. The variable beam control antenna as claimed in claim 1, wherein the frame unit having the signal processing and control equipment for signal processing operations for amplification and filtering of transmitted or received signals of the corresponding antenna and control operations for posture control of the antenna, and heat radiation pins are formed on an outer surface to discharge heat.

3. The variable beam control antenna as claimed in claim 1, wherein each radiation element of the radiation units is composed of a dipole element having a radiator and a balloon structure, the radiator is formed in a partially spherical shape that is convex in a forward direction as a whole, and a reflection plate of each of the radiation units is formed in a dish shape or a partially spherical shape that has a concave portion with respect to the radiation element.

4. The variable beam control antenna as claimed in claim 3, wherein the radome is formed so that its surfaces, which correspond to respective convex radiation elements of the radiation units, similarly have partially spherical surfaces that are convex in the forward direction.

5. The variable beam control antenna as claimed in claim 1, wherein multiple phase shifters are mounted on the rack gear unit for electric vertical beam tilt.

* * * * *